United States Patent [19]

Takeda et al.

[11] 4,137,714

[45] Feb. 6, 1979

[54] INTERNAL COMBUSTION ENGINE SECONDARY AIR SUPPLY CONTROL SYSTEM

[75] Inventors: Keiso Takeda, Susono; Hideo Miyagi, Toyota, both of Japan

[73] Assignee: Toyota Jidosha Kogyo Kabushiki Kaisha, Toyota, Japan

[21] Appl. No.: 804,985

[22] Filed: Jun. 9, 1977

[30] Foreign Application Priority Data

Mar. 4, 1977 [JP] Japan ..... 52-22802

[51] Int. Cl.[2] ..... F02B 75/10; F01N 3/15

[52] U.S. Cl. ..... 60/276; 60/289

[58] Field of Search ..... 60/276, 289, 290

[56] References Cited

U.S. PATENT DOCUMENTS

| | | | |
|---|---|---|---|
| 3,911,674 | 10/1975 | Goto | 60/290 |
| 3,931,710 | 1/1976 | Hartel | 60/290 |
| 3,962,867 | 6/1976 | Ikeura | 60/290 |
| 4,068,472 | 1/1978 | Takata | 60/290 |

*Primary Examiner*—Douglas Hart

[57] ABSTRACT

An internal combustion engine having an exhaust system provided with exhaust gas purifying means and secondary air supplying means disposed upstream thereof includes a secondary air supply control system comprising vacuum introducing means adapted to introduce and reserve the vacuum from an intake manifold vacuum port; secondary air switching means including two diaphragm means and a valve mechanism linked therewith; information processing means adapted to process the information from an $O_2$ sensor and an acceleration detector and issue selective commands; and vacuum switching means including two vacuum switching valves to be controlled by the command associated with the $O_2$ sensor, and an additional vacuum valve disposed between each of the two vacuum switching valves and two atmosphere openings of the valve which are provided with respective orifices of different throttling capabilities, both additional vacuum valves being adapted to be controlled by the command associated with the acceleration detector.

1 Claim, 3 Drawing Figures

INTERNAL COMBUSTION ENGINE SECONDARY AIR SUPPLY CONTROL SYSTEM

BACKGROUND OF THE INVENTION

1. Field of the Invention

This invention relates in general to an exhaust gas purifying system for an internal combustion engine, and more particularly to a secondary air supply control system which controls the mixture of exhaust gas and secondary air with high accuracy so as to bring the gas mixture near the stoichiometric air fuel ratio.

2. Description of the Prior Art

In an internal combustion engine having an exhaust system provided with a catalytic device and a secondary air supply system positioned upstream thereof, it is desirable to control the secondary air fuel ratio to the theoretical ratio (excess air ratio $\lambda=1$) in conformity with the operating condition. However, in the prior art system wherein secondary air supplied from its source is delivered, through the operation of an air by-pass valve responsive to the vacuum in the intake manifold, to a secondary air switching valve which is actuated by the manifold vacuum through a vacuum transmitting valve, there occur fluctuations in the amount of injected secondary air according to the position of the air switching valve so that difficulties have been encountered in accomplishing optimal secondary air compensation. Means have therefore been wanted to ensure sufficiently accurate secondary air supply to achieve the desired effect.

Particularly it is necessary under various operating conditions of the engine to obtain respective suitable rates of change in secondary air flow to maintain the secondary air fuel ratio in the exhaust system at the theoretical value (excess air ratio $\lambda=1$).

In the prior art system, the speed of change in secondary air flow is varied by orifices, which however is fixed in diameter, thus posing a problem to solve in practicing suitable secondary air supply for all different engine running conditions.

Therefore, for the purpose of controlling the mixture of exhaust gas and secondary air with high accuracy so as to bring its excess air ratio near the optimal value ($\lambda=1$) by decreasing or increasing the supplied amount of secondary air according to whether the excess air ratio detected by an $O_2$ sensor provided in the exhaust system is larger or smaller than unity ($\lambda>1$ or $\lambda<1$) respectively, it is required to change the rate of operation or response of the secondary air switching valve according to the rate of change in inlet air flow.

SUMMARY OF THE INVENTION

In order to attain the above discussed purpose, the present invention aims to provide a secondary air supply control system wherein atmosphere inducing orifices arranged in pairs as elements for determining the operation rate of a secondary air switching valve are adapted for switching between the orifices of each pair for either of two categories of engine operating modes, that is, a first category (steady operation, idling and deceleration) wherein the rate of change in inlet air flow is low, and a second category (acceleration) wherein the change rate is high.

This invention is characterized by providing a system comprising vacuum introducing means, vacuum switching means, secondary air switching means, and information processing means, the vacuum switching means including vacuum control or switching valves provided with orifices opening to the atmosphere which are so paired as to be selectively used in response to the engine operation mode information from an $O_2$ sensor and an acceleration detector.

According to such arrangement of the present invention, by the changeover between the two orifices of each vacuum switching valve controlled by the selective signal received from the acceleration detector to determine the response rate of the secondary air switching valve, it is possible to match the response rate of the valve to either of the two operation categories different in the required rate of change in secondary air flow, thus enabling the mixture of exhaust gas and secondary air to be controlled so accurately as to approach the optimal excess air ratio ($\lambda=1$), with a resultant remarkable effect in exhaust gas purification.

DESCRIPTION OF THE PREFERRED EMBODIMENT

Figure 1:
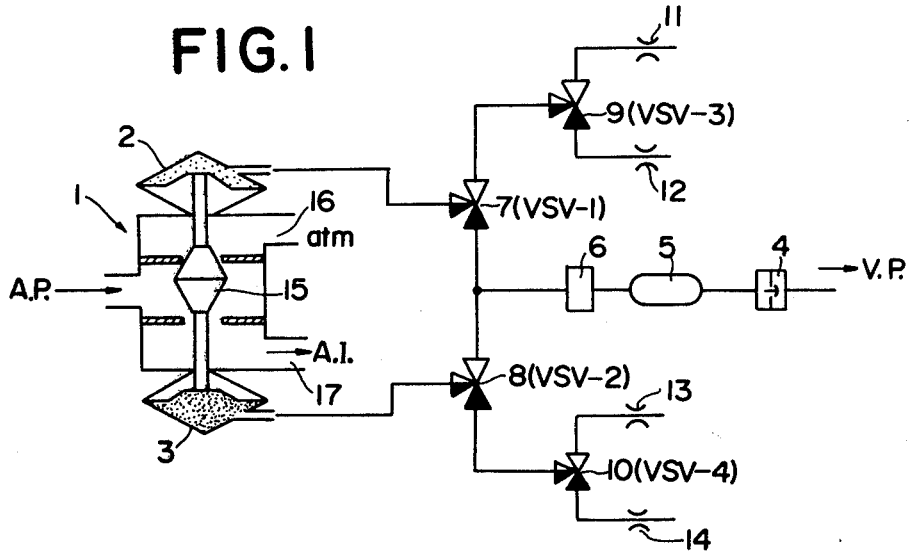
FIGS. 1 and 2 schematically illustrate the composition and function of a functional portion of a secondary air supply control system embodying the present invention, showing the system as functioning when the mixture in the exhaust system is rich and lean, respectively.
Figure 2:
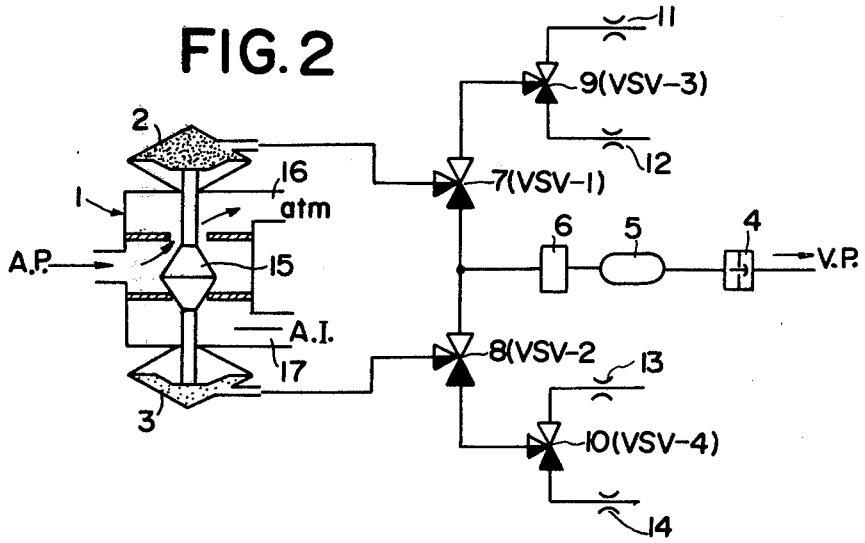
Figure 3:
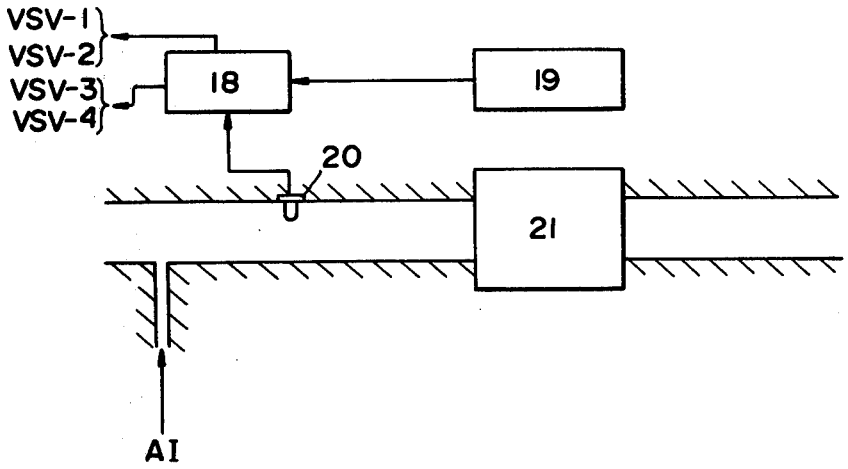
FIG. 3 is a diagrammatic illustration of an information processing system which constitutes a part of the present invention.

Referring now to the accompanying drawings, and particularly to FIGS. 1 and 2, which show a functional portion of a secondary air supply control system embodying the present invention in the condition of supplying an increased amount of secondary air and in the condition of interrupting such supply, respectively; the system of the invention includes vacuum introducing means, vacuum switching means, and secondary air switching means. The vacuum introducting means comprise a vacuum transmitting valve 4 in fluid communication with an intake manifold vacuum port V.P., and a vacuum reservoir 5 and a vacuum control valve 6 which are connected in series flow relationship with the vacuum transmitting valve 4. The vacuum switching means include a first vacuum switching valve 7 (VSV-1), a second switching valve 8 (VSV-2) and two vacuum switching valves 9 (VSV-3) and 10 (VSV-4) provided with respective pairs of orifices 11, 12 and 13, 14 adapted for two-step control of the vacuum switching valves 7 and 8 respectively. The secondary air switching means include a secondary air switching valve generally represented by 1, which has diaphragm means including a first diaphragm chamber 2, a second diaphragm chamber 3, and two diaphragms operatively connected respectively to opposed ends of two valve stems oppositely extending from a valve head 15 adapted to perform such a switching function as to communicate secondary air with either an atmosphere port 16 or a secondary air delivery port 17 by the cooperation of both diaphragm chambers. Furthermore, as seen in FIG. 3, which shows an information processing system, the exhaust system is provided with a catalytic converter 21 and information processing means which include a computer 18 for processing the information from an $O_2$ sensor 20 located upstream of the catalytic converter 21 and the information from an acceleration detector 19 and together with the above-mentioned other means, compose the system of the present invention.

VSV-1 and VSV-2 used in the rich mode and lean mode, respectively, are normally controlled by the signal from the $O_2$ sensor 20 through the operation of the computer 18 in such a manner as to be set, when the exhaust mixture is rich in fuel, in the ON positions, (for the first fluid communication system) to deliver secondary air into the exhaust system, and when the mixture is lean, in the OFF positions (for the second fluid communication system) to shut off the delivery of secondary air. VSV-3 and VSV-4, used in the acceleration mode and the deceleration mode, respectively, controlled by the signal issued by the acceleration detector 19 and processed by the computer 18, and are provided with respective orifices which are different in throttling capability and so paired as to be selectively used for either the category of engine operating conditions (steady running, idling and deceleration) wherein the rate of change in inlet air flow is low or the operation category (acceleration) wherein the change rate is high, thereby controlling the response rate of the secondary air switching valve to maintain the exhaust gas mixture in the vicinity of $\lambda=1$.

Reference is now made again to FIG. 1, when acceleration gives rise to a rich mixture in the exhaust system, the manifold vacuum led through the vacuum transmitting valve 4 into the vacuum reservoir 5 and kept therein is conducted through VSV-1 into the first diaphragm chamber 2, pursuing the first communication line shown in the figure. The vacuum thus conducted tends to move the diaphragm upward as viewed in the figure. At the same time, VSV-2, which is closed with respect to the vacuum system, allows the ambient air admitted through either of its specific orifices 13 and 14 provided in atmosphere openings to pass into the second diaphragm chamber 3. In this case, VSV-1 is fluidly isolated from VSV-3 connected thereto. Meanwhile, VSV-4 connected to VSV-2 allows atmospheric air to pass into the second diaphragm chamber 3 through either orifice 13 or 14 and through VSV-2 in response to the selective signal for either of the aforesaid two engine operation categories differing in air flow change rate. The resulting pressure build-up in the second diaphragm chamber 3 cooperates with the suction effect of the first diaphragm chamber 2 to move the valve head 15 upward as viewed in the figure, so that secondary air is delivered into the exhaust system through the delivery port 17 of the secondary air switching valve 1.

Referring to FIG. 2, which is a functional illustration associated with the condition wherein the exhaust mixture is lean, the vacuum switching valves are actuated by the computer 17 so as to establish the second communication system. Thus, the intake manifold vacuum is introduced into the second diaphragm chamber 3 through VSV-2. Meanwhile, VSV-1 is closed to the manifold vacuum communication system; however, this valve allows atmospheric air to pass through VSV-3 into the first diaphragm 2, thus serving to move the valve head 15 downward as viewed in the figure. In this case, the selection of either of the atmosphere inducing orifices associated with VSV-3 is effected by the command signal issued from the computer according to which of the aforementioned two categories of engine operating conditions is detected. As apparent from the foregoing description, the throttling capabilities of the orifices 11 through 14 can be optionally determined according to the engine ratings, performance, use, and so forth.

What is claimed is:

1. In an internal combustion engine having an exhaust system provided with exhaust gas purifying means and secondary air supplying means disposed upstream thereof; a secondary air supply control system comprising vacuum introducing means adapted to introduce intake manifold vacuum from an intake manifold vacuum port through a vacuum transmitting valve into a vacuum reservoir and reserve the manifold vacuum in said reservoir; secondary air switching means including two diaphragm means and a valve mechanism linked therewith; information processing means adapted to process the information from an $O_2$ sensor and an acceleration detector and issue selective commands; and vacuum switching means including two vacuum switching valves to be controlled by the command associated with said $O_2$ sensor, and an additional vacuum valve disposed between each of said two vacuum switching valves and two atmosphere openings of the valve, both said additional vacuum valves being adapted to be controlled by the command associated with said acceleration detector, said two atmosphere openings of each additional vacuum valve being provided with respective orifices of different throttling capabilities.

* * * * *